US010260501B2

(12) United States Patent
Shook et al.

(10) Patent No.: US 10,260,501 B2
(45) Date of Patent: Apr. 16, 2019

(54) BEARING STRUCTURES FOR GEAR PUMPS

(71) Applicant: Hamilton Sundstrand Corporation, Charlotte, NC (US)

(72) Inventors: Ryan Shook, Rockford, IL (US); Weishun Ni, Rockton, IL (US); Joseph Wetch, Roscoe, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 199 days.

(21) Appl. No.: 15/238,619

(22) Filed: Aug. 16, 2016

(65) Prior Publication Data

US 2018/0051696 A1 Feb. 22, 2018

(51) Int. Cl.

| | |
|---|---|
| ***F04C 2/18*** | (2006.01) |
| ***F04C 15/00*** | (2006.01) |
| ***F04C 15/06*** | (2006.01) |

(52) U.S. Cl.

CPC ..... *F04C 15/0026* (2013.01); *F04C 2/18* (2013.01); *F04C 15/06* (2013.01); *F04C 2240/56* (2013.01)

(58) Field of Classification Search

CPC ..... F04C 15/06; F04C 2/18

See application file for complete search history.

(56) References Cited

U.S. PATENT DOCUMENTS

| | | | | |
|---|---|---|---|---|
| 9,068,568 | B2 * | 6/2015 | Heitz | F04C 2/18 |
| 2013/0319153 | A1 * | 12/2013 | Ni | F04C 2/18 74/421 R |
| 2016/0208611 | A1 * | 7/2016 | Veilleux, Jr. | F04C 2/18 |
| 2016/0369795 | A1 * | 12/2016 | Vacca | F04C 2/18 |

OTHER PUBLICATIONS

Extended European Search Report, of the European Patent Office, dated Dec. 15, 2017 in corresponding European Patent Application No. 17186494.5.

* cited by examiner

*Primary Examiner* — Mary Davis

(74) *Attorney, Agent, or Firm* — Locke Lord LLP; Daniel J. Fiorello; Scott D. Wofsy

(57) ABSTRACT

A bearing structure for abutting a pair of gears of a gear pump includes a body including a face on which the gears rotate, an inlet defined in the body, and an outlet defined in the body. The bearing structure includes a sealing portion of the face configured to fluidly seal the inlet from the outlet, the sealing portion being defined as a portion of the face in sealing engagement with the gears at a rotational position of the gears wherein a volume contained by teeth of the gears and the face is constant or about constant as the gears rotate.

16 Claims, 6 Drawing Sheets

BEARING STRUCTURES FOR GEAR PUMPS

BACKGROUND

1. Field

The present disclosure relates to gear pumps, more specifically to bearing structures for gear pumps.

2. Description of Related Art

The process of cavitation in a gear pump is where, in operation, localized depressions in static pressure cause the pumped fluid to fall below the vapor pressure of the liquid (e.g., which creates bubbles). Cavitation is caused by sealing a volume and expanding the fixed volume. When the pressure of the vaporized fluid increases, collapse of the vapor can be damaging to the pump hardware which can negatively impact service life. Face cuts made to a bearing of the gear pump have been shown to have an impact on the realization of fluid cavitation in a gear pump. However, existing face cut geometries are insufficient.

Such conventional methods and systems have generally been considered satisfactory for their intended purpose. However, there is still a need in the art for improved bearing structures for gear pumps. The present disclosure provides a solution for this need.

SUMMARY

A bearing structure for abutting a pair of gears of a gear pump includes a body including a face on which the gears rotate, an inlet defined in the body, and an outlet defined in the body. The bearing structure includes a sealing portion of the face configured to fluidly seal the inlet from the outlet, the sealing portion being defined as a portion of the face in sealing engagement with the gears at a rotational position of the gears wherein a volume contained by teeth of the gears and the face is constant or about constant as the gears rotate. The structure can include pair of apertures defined by the body and configured to receive a gear shaft.

The sealing portion can include a point symmetric shape about a midpoint of the body. The sealing portion can include a main portion having a main portion width. In certain embodiments, the main portion width can be about equal to a root pocket arc length of gear teeth in the pair of gears and wherein the main portion is straight.

Two 90 degree corners can extend from the main portion of the sealing portion on opposite sides of the main portion, the corners defining a first edge and a second edge. The first edge and the second edge can be flat, for example.

In certain embodiments, the first edge of each corner can be defined parallel to a line of action of the gears. The second edge of each corner can be defined parallel to a contact length line.

In certain embodiments, the sealing portion can be defined in the face by machining (e.g., cutting). However, the bearing structure can be additively manufactured or made in any other suitable manner to form the sealing portion.

A method can include determining a shape of a sealing portion of a bearing structure for gears of a gear pump based on gear geometry such that a sealed portion only exists where volume between gear teeth is substantially constant. Determining a shape of the sealing portion can include using a contact length of the gears.

Determining a shape of the sealing portion can include using a line of action of the gears. Determining a shape of the sealing portion can include using a root arc length of the gears.

A method for pumping a fluid with a gear pump can include sealing a volume defined between gear teeth, an inlet, and an outlet only at angles of rotation of the gears where the volume remains constant.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
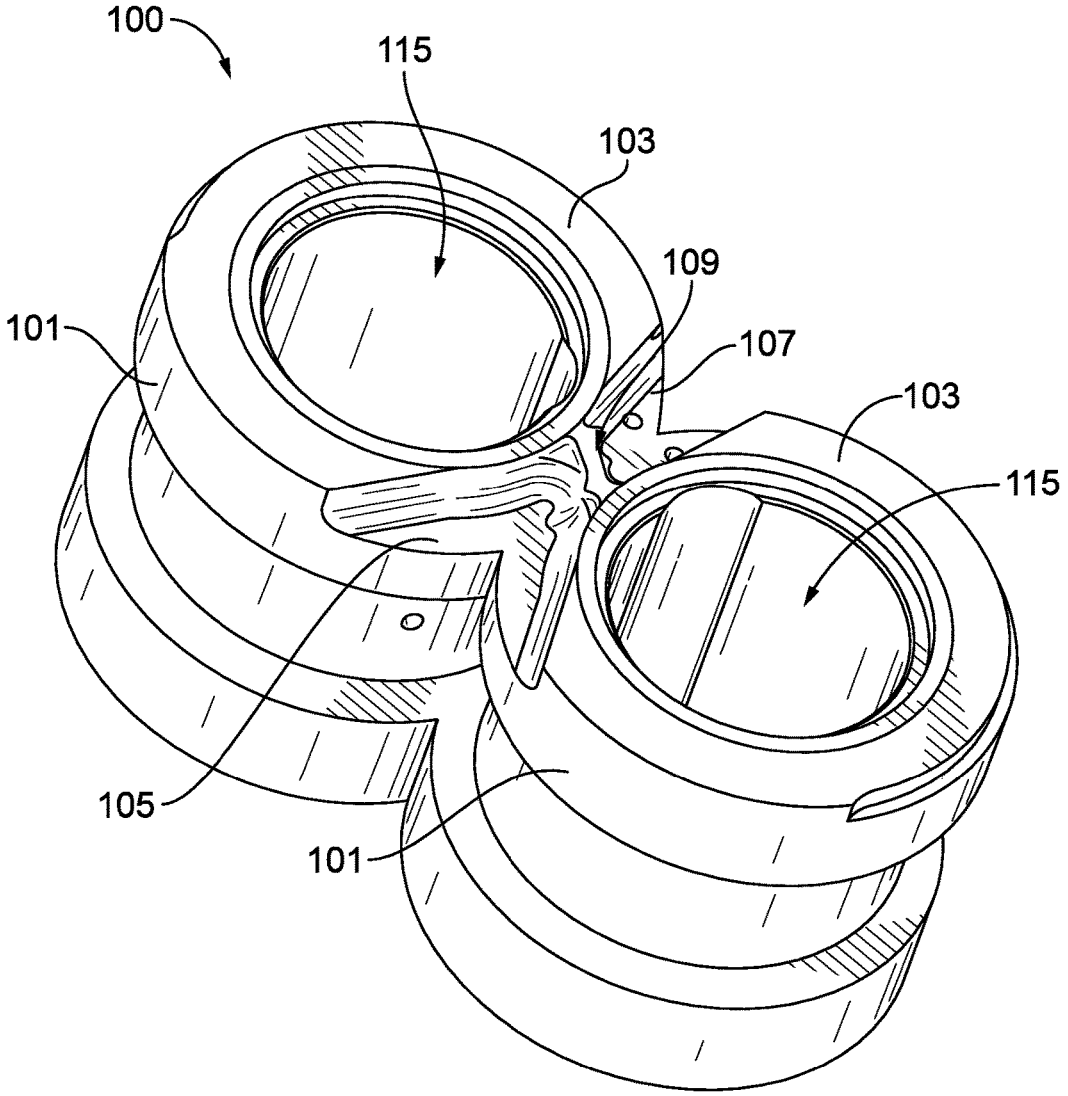
FIG. 1 is a perspective view of an embodiment of a bearing structure in accordance with this disclosure.

Reference will now be made to the drawings wherein like reference numerals identify similar structural features or aspects of the subject disclosure. For purposes of explanation and illustration, and not limitation, an illustrative view of an embodiment of a structure in accordance with the disclosure is shown in FIG. 1 and is designated generally by reference character 100. Other embodiments and/or aspects of this disclosure are shown in FIGS. 2A-5. The systems and methods described herein can be used to reduce and/or eliminate cavitation in gear pumps, for example.

Referring to FIG. 1, an embodiment of a bearing structure 100 for abutting a pair of gears of a gear pump includes a body 101. The body 101 has a face 103 on which the gears rotate. As appreciated by those having ordinary skilled in the art, the face 103 defines a lateral boundary for the gears to create pumping action. The body 101 also defines inlet 105 and an outlet 107.

Figure 2A:
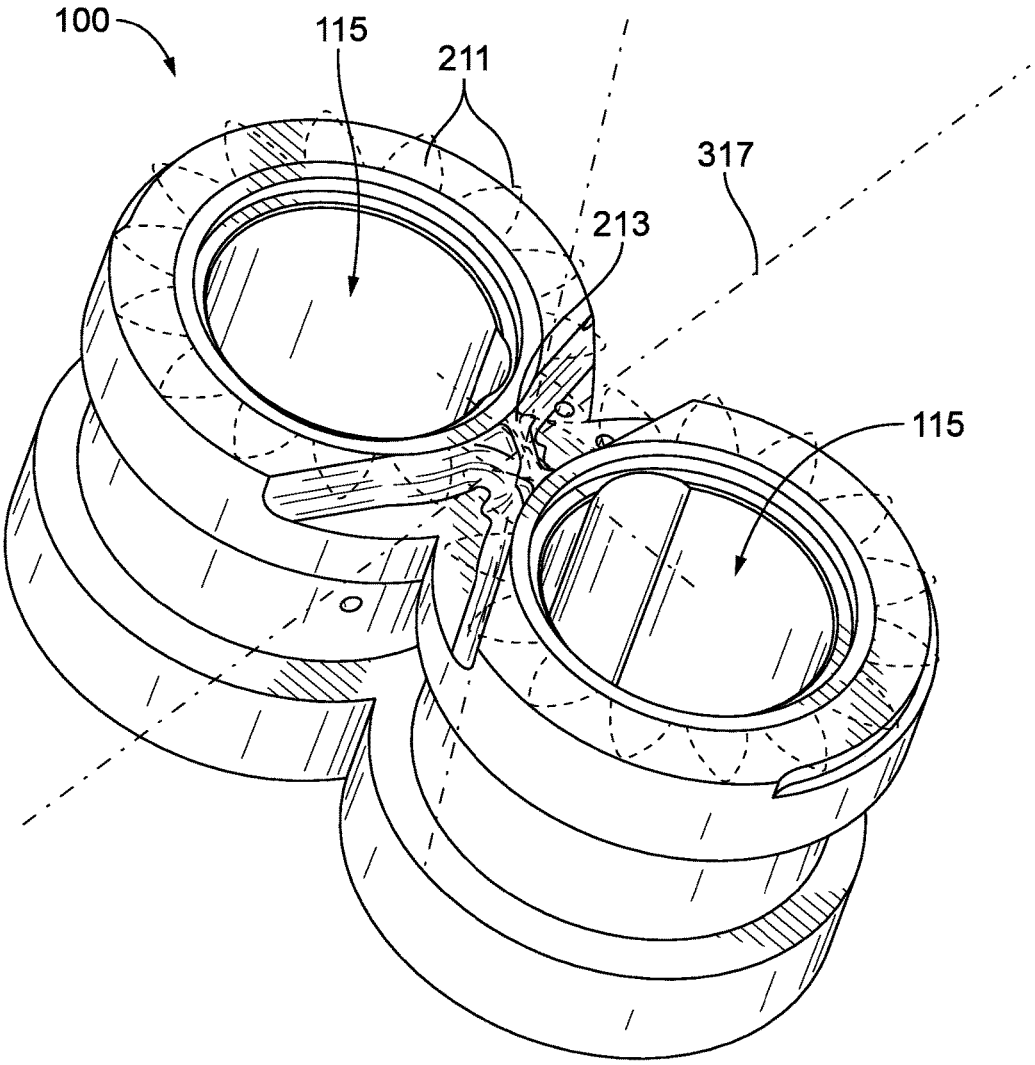
FIG. 2A is a perspective view of the embodiment of FIG. 1, shown having gear geometry planforms schematically overlayed on the face of the bearing structure.
Figure 2B:
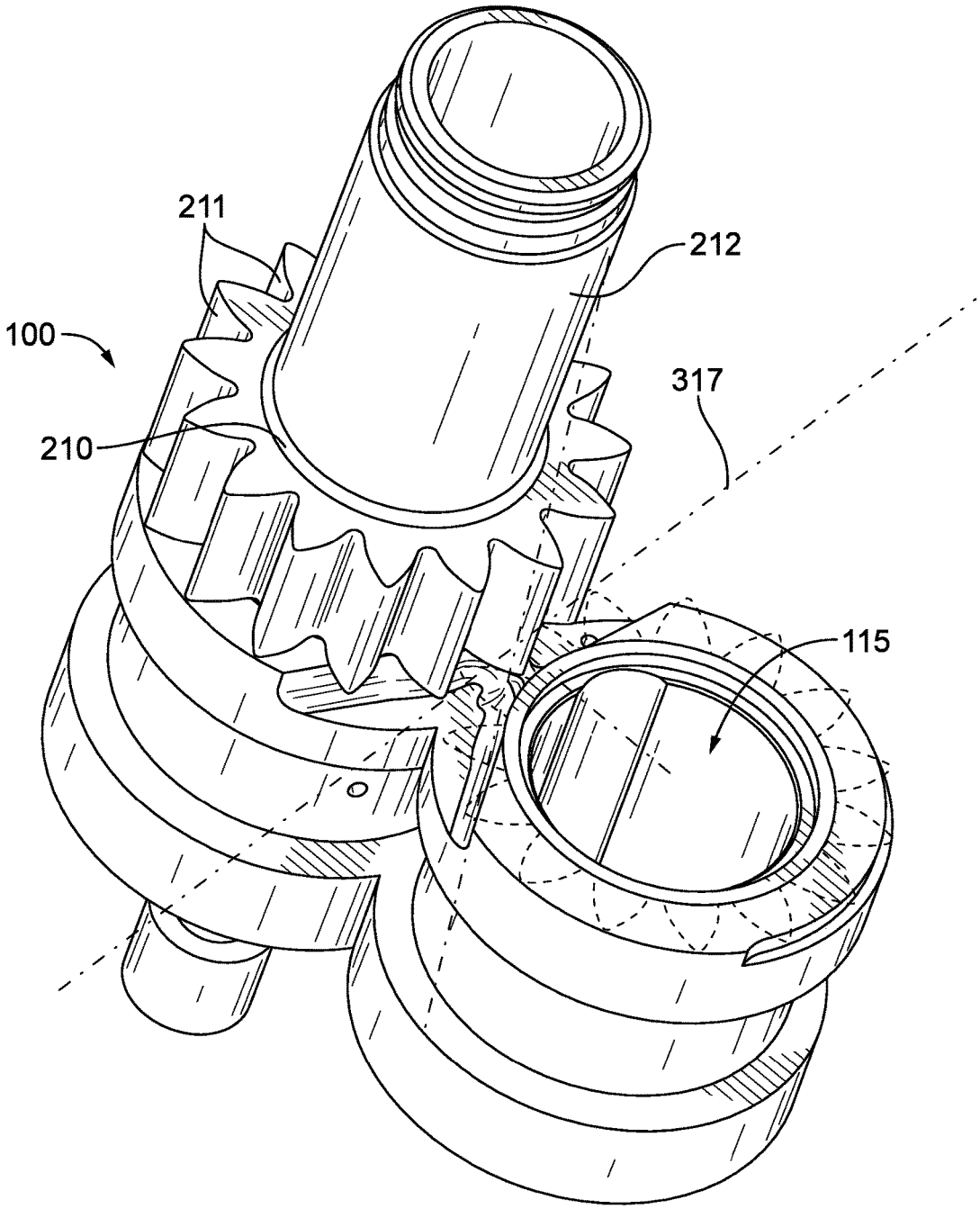
FIG. 2B is a perspective view of the embodiment of FIG. 1, shown having gear geometry planforms schematically overlayed on the face of the bearing structure and a gear disposed on the bearing structure.
Figure 2C:
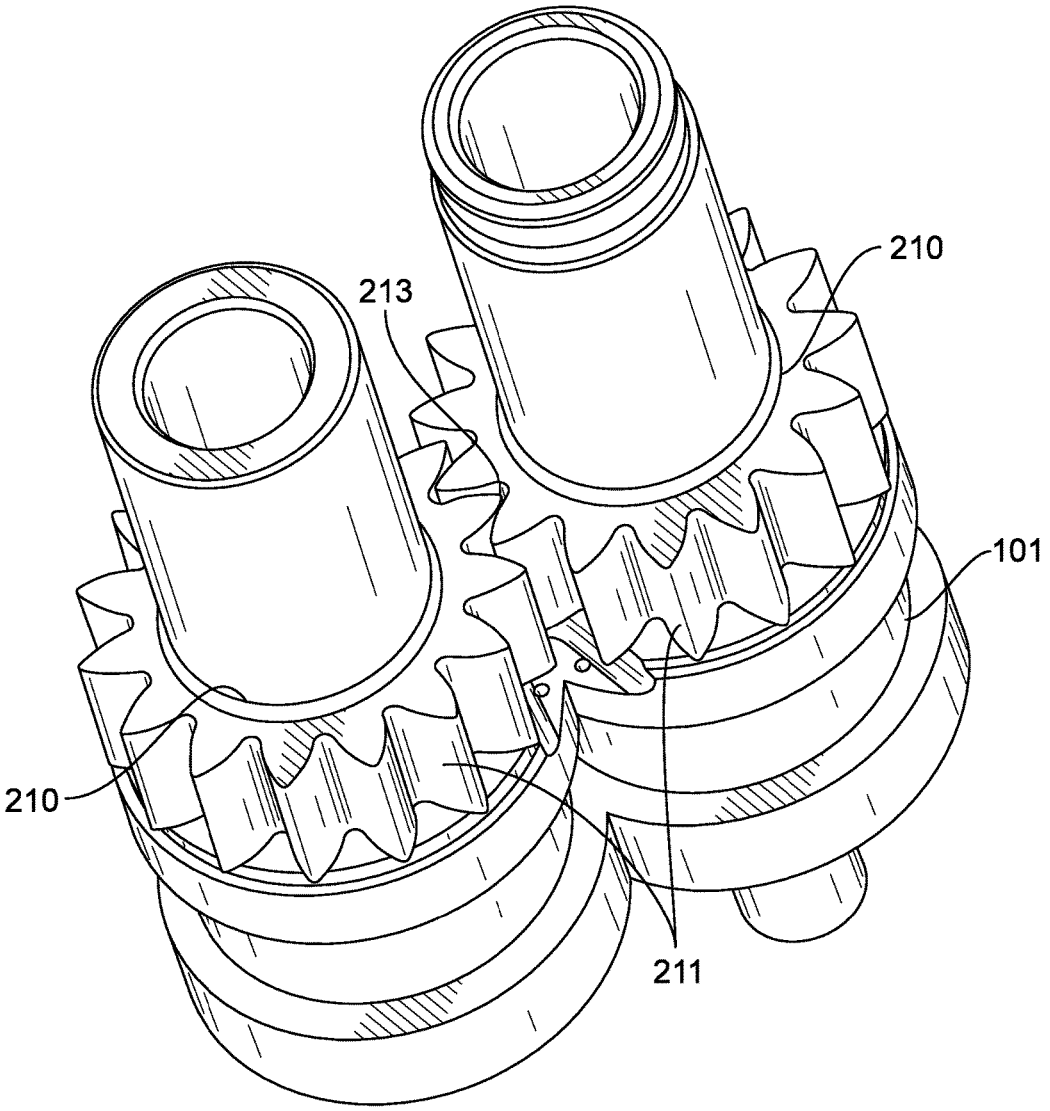
FIG. 2C is a perspective view of the embodiment of FIG. 1, shown having a pair of gears disposed on the bearing structure.

The bearing structure 100 includes a sealing portion 109 defined by the face 103 and configured to fluidly seal the inlet 105 from the outlet 107 (e.g., when the gears are assembled in the gear pump). Referring additionally to FIGS. 2A, 2B, and 2C, the sealing portion 109 is shaped to seal a space 213 between gear teeth 211 only when the volume between the gear teeth 211 is constant or about constant (e.g., within manufacturing tolerances or otherwise) to limit and/or prevent cavitation between the gear teeth 211. A bearing structure for abutting a pair of gears of a gear pump includes a body including a face on which the gears rotate, an inlet defined in the body, and an outlet defined in the body. The sealing portion 109 can be defined as a portion of the face 103 in sealing engagement with the gears at a rotational position of the gears wherein a volume contained by teeth 211 of the gears and the face 103 is constant or about constant as the gears rotate.

The term "about constant" can be defined as a change in volume that is understood by those having ordinary skill in the art to have a negligible effect on cavitation and/or to account for manufacturing tolerances. While disclosed in certain embodiments, it is not necessary that the volume be exactly constant where the sealing portion 109 seals.

As appreciated by those having ordinary skill in the art, the structure 100 can include pair of apertures 115 defined by the body 101 and configured to receive a gear shaft 212 of a gear 210. It is also contemplated that the structure 100 can be any suitable number of parts (e.g., split in half at a midline 317) or can be a single piece. Any other suitable structure is contemplated herein, so long as the structure 100 is configured to allow two gears to rotate on the face 103 thereof.

Figure 3:
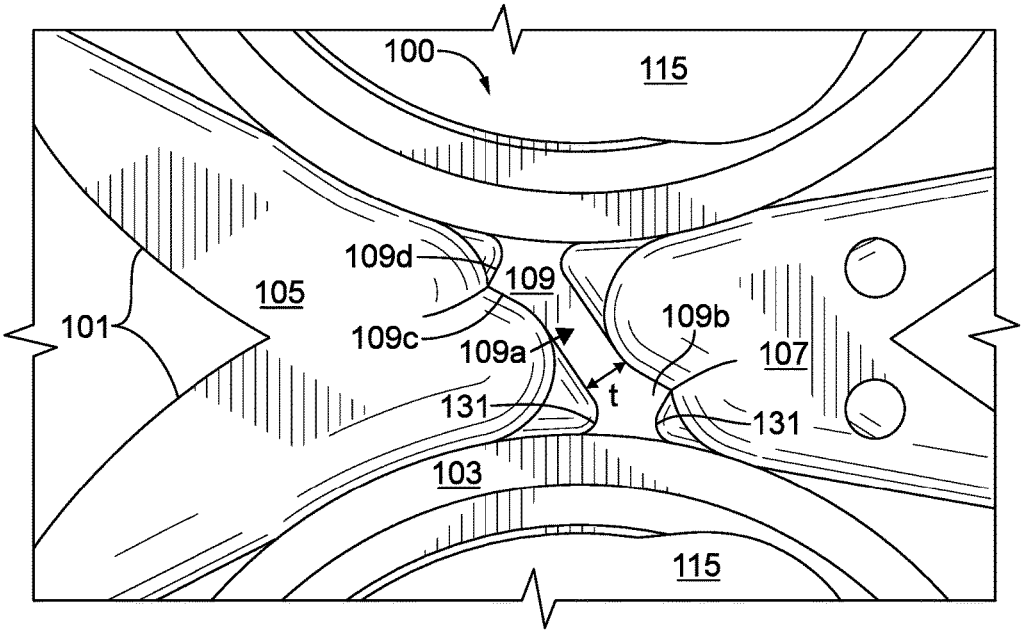
FIG. 3 is a plan view of the embodiment of FIG. 1.

Referring additionally to FIG. 3, the sealing portion 109 can include a mirrored symmetric shape about the midline 317 of the body 101. The sealing portion 109 can include a main portion 109*a* having a main portion width "t". In certain embodiments, the main portion width "t" can be about equal to a root pocket arc length (as depicted) of gear teeth 211 in the pair of gears 210. As shown, the main portion 109*a* can be straight (e.g., have parallel edges).

Two 90 degree corners 109*b* can extend from the main portion 109*a* of the sealing portion 109 on opposite sides of the main portion 109. The corners 109*b* can define a first edge 109*c* and a second edge 109*d*. The first edge 109*c* and the second edge 109*d* can be flat, for example, or any other suitable shape.

Figure 4:
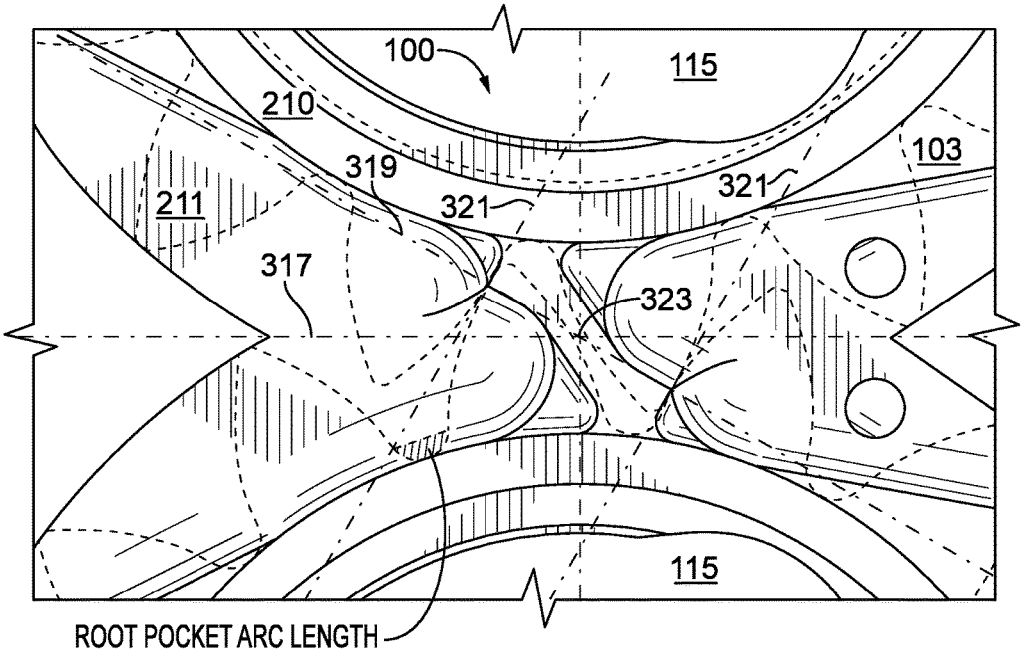
FIG. 4 is a plan view of the embodiment of FIG. 1, shown having gear geometry planforms schematically overlayed on the face of the bearing structure.

Referring additionally to FIG. 4, in certain embodiments, the first edge 109*c* of each corner 109*b* can be defined parallel to a line of action 319 of the gears 210. The line of action 319 is the line along which contact between the two gears occurs and/or which all the gear forces act (e.g., at 30 degrees to the horizontal midline 317 in the embodiment shown).

The second edge 109*d* of each corner can be defined parallel to a contact length line 321, for example. The contact length lines 321 are the lines that define the length over which two gear teeth 211 are in contact when contact points on symmetrically located gear teeth 211 are equidistant of center point of contact 323. The lines of contact 321 can also be perpendicular to the line of action 319 and/or tangent to the involute profile of the gear teeth 211 at point of contact. Irrespective of the geometry of the gear teeth 211, the corners 109*b* can have 90 degree turns from the first face 109*c* to the second face 109*d*. However, the perpendicularity to the line of action can be varied in any suitable manner as appreciated by those having ordinary skill in the art in view of this disclosure.

Figure 5:
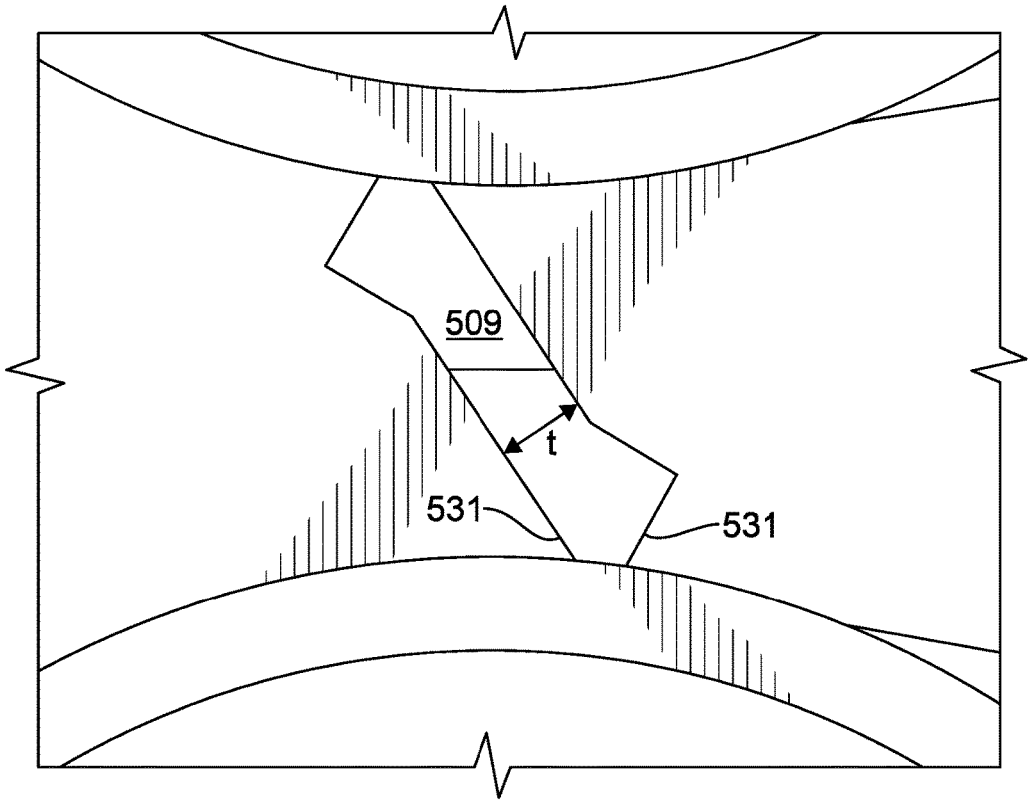
FIG. 5 is a schematic plan view of an embodiment of a bearing structure in accordance with this disclosure, shown having straight root lines of the sealing portion of the face.

While the embodiments of FIGS. 1-4 show a sealing portion having curved roots 131 (see FIG. 3), these curved roots can be eliminated from the structure (e.g., to more closely match the theoretical ideal shape. For example, as shown in FIG. 5, another embodiment of a sealing portion 509 is shown having straight edges 531 all the way to the root. Also, any suitable surrounding structure for the sealing portions 109, 509 is contemplated herein.

In certain embodiments, the sealing portion 109 can be defined in the face by machining (e.g., cutting), which may limit designs (e.g., to those with curved roots 131 due to cutting radius). However, the bearing structure 100 can be additively manufactured or made in any other suitable manner to form the sealing portion 109 in any suitable configuration (e.g., with straight edges 531).

A method can include determining a shape of a sealing portion of a bearing structure for gears of a gear pump based on gear geometry such that a sealed portion only exists where volume between gear teeth is substantially constant. Determining a shape of the sealing portion can include using a contact length of the gears. Determining a shape of the sealing portion can include using a line of action of the gears. Determining a shape of the sealing portion can include using a root arc length of the gears.

As described above, embodiments allow determination of sealing geometry of a bearing structure as a function of given gear geometry. Therefore, embodiments allow application to any gear geometry to prevent cavitation. Traditional face cuts have been arranged in a way where the layout has been application specific and without consideration to the actual volume rate of change within the trapped volumes of the gear pump elements.

The methods and systems of the present disclosure, as described above and shown in the drawings, provide for bearing structures for gear pumps with superior properties including cavitation prevention and/or elimination. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A bearing structure for abutting a pair of gears of a gear pump, comprising:

a body including a face on which the gears rotate;

an inlet defined in the body;

an outlet defined in the body; and a sealing portion of the face configured to fluidly seal the inlet from the outlet, the sealing portion being defined as a portion of the face in sealing engagement with the gears at a rotational position of the gears only wherein a volume contained by teeth of the gears and the face is constant or about constant as the gears rotate such that the sealing portion only exists where volume between gear teeth is constant or about constant as the gears rotate.

2. The bearing structure of claim 1, wherein the sealing portion includes a point symmetric shape about a midpoint of the body.

3. The bearing structure of claim 2, wherein the sealing portion includes a main portion having a main portion width.

4. The bearing structure of claim 3, wherein the main portion width is about equal to a root pocket arc length of gear teeth in the pair of gears and wherein the main portion is straight.

5. The bearing structure of claim 3, wherein two 90 degree corners extend from the main portion of the sealing portion on opposite sides of the main portion, the corners defining a first edge and a second edge.

6. The bearing structure of claim 5, wherein the first edge and the second edge are flat.

7. The bearing structure of claim 6, wherein the first edge of each corner is defined parallel to a line of action of the gears.

8. The bearing structure of claim 7, wherein the second edge of each corner is defined parallel to a contact length line.

9. The bearing structure of claim 1, wherein the sealing portion is defined in the face by machining.

10. The bearing structure of claim 1, wherein the bearing structure is additively manufactured.

11. The bearing structure of claim 1, comprising a pair of apertures defined by the body and configured to receive a gear shaft.

12. A method for manufacturing a bearing structure for a gear pump, comprising:

defining a shape of a sealing portion of a bearing structure for gears of a gear pump based on gear geometry such that a sealed portion only exists where volume between gear teeth is substantially constant as the gears rotate.

13. The method of claim 12, wherein determining a shape of the sealing portion includes using a contact length of the gears.

14. The method of claim 12, wherein determining a shape of the sealing portion includes using a line of action of the gears.

15. The method of claim 12, wherein determining a shape of the sealing portion includes using a root arc length of the gears.

16. A method for pumping a fluid with a gear pump, comprising:

sealing a volume defined between gear teeth, an inlet, and an outlet only at angles of rotation of the gears where the volume remains constant.

* * * * *